US005769674A

United States Patent [19]

Stallman

[11] Patent Number: 5,769,674

[45] Date of Patent: Jun. 23, 1998

[54] JET DRIVE FOR OUTBOARD MOTOR

[75] Inventor: Richard C. Stallman, Alameda, Calif.

[73] Assignee: Specialty Manufacturing Co., San Leandro, Calif.

[21] Appl. No.: 694,928

[22] Filed: Aug. 8, 1996

[51] Int. Cl.[6] ..... B63H 11/00

[52] U.S. Cl. ..... 440/38; 440/46

[58] Field of Search ..... 440/38, 39, 40, 440/41, 42, 46, 47; 114/151; 60/221

[56] References Cited

U.S. PATENT DOCUMENTS

| | | | |
|---|---|---|---|
| 2,149,155 | 2/1939 | Anderson | 440/47 |
| 2,702,516 | 2/1955 | Tinker | 440/47 |
| 3,249,083 | 5/1966 | Irgens | 440/38 |
| 3,323,502 | 6/1967 | Whalen | 440/88 |
| 3,389,558 | 6/1968 | Hall | 60/221 |
| 3,993,015 | 11/1976 | Klepacz et al. | 44/47 |
| 5,383,801 | 1/1995 | Chas | 440/38 |

*Primary Examiner*—Ed L. Swinehart
*Attorney, Agent, or Firm*—Flehr, Hohbach, Test, Albritton, & Herbert LLP

[57] ABSTRACT

A jet propulsion system for propelling a water craft through a body of water. The system includes a housing having a conduit formed therein for the passage of water, an inlet port and an outlet port. The inlet port has a lower edge which extends at least to the vertical plane defined by the upper edge such that the inlet port faces away from the bottom of the river or lake. An impeller is positioned in the housing between the inlet and outlet ports, and a stator structure is positioned between the impeller and the outlet port. The impeller is rotated by a drive assembly to draw water inwardly through the inlet port, drive the water past the impeller in an axial/rotational flow, and move the water through the outlet port. A coolant delivery system for delivering a supply of water for cooling the drive assembly includes a coolant passageway for transporting water from the conduit to a pump reservoir coupled to the drive assembly, and an inlet aperture opening into the conduit between the impeller and the outlet port.

22 Claims, 4 Drawing Sheets

JET DRIVE FOR OUTBOARD MOTOR

BRIEF DESCRIPTION OF THE INVENTION

The invention relates in general to a marine jet propulsion system and, more particularly, to a jet drive for propelling canoes and other water craft with displacement hulls.

BACKGROUND OF THE INVENTION

Boats, canoes and other water craft are typically driven by either a propeller or jet propulsion system coupled to an outboard motor. With jet propulsion systems, an impeller driven by the outboard motor draws water through an inlet into the jet housing and forces the water at high pressure through a nozzle-shaped outlet directed rearwardly of the boat. The inlet of the jet housing faces in a downward-forward direction, and is typically covered by screen to prevent large debris from entering the housing. However, the screens do not prevent fine sand and sediment from entering the jet housing.

The propulsion systems often include separate inlets for delivering a supply of water to the motor as coolant. Screens and/or filter bowls are used to reduce the amount of debris entering the cooling jacket. However, these screens become clogged and the filter bowls become filled with debris, requiring cleaning or replacement of the screens and emptying of the bowls. Since the screens do not completely obstruct the passage of fine sand and other sediment, this material collects in the motor cooling water jackets and reduces the volume available for the cooling water. Over time, this reduction in cooling area can cause overheating of the motor.

U.S. Pat. No. 3,249,083 discloses an example of a marine jet propulsion device. The disclosed device includes a drive inlet which is angled to face in a forward and downward direction and a pair of coolant inlets positioned above the main inlet covered by screens. An anti-spray plate maintains water pressure adjacent the coolant inlet and prevents the water from being sprayed upward relative to the housing exterior. A lining of rubber material is applied to the housing interior around the rotor blades to reduce erosion of the blades by grit and other materials.

A jet propulsion system which minimizes the amount of sand, sediment and other debris entering the jet housing is desirable. A jet drive which substantially eliminates fine sand and sediment from the coolant water is also desirable.

OBJECTS AND SUMMARY OF THE INVENTION

It is a primary object of the present invention to provide a jet propulsion system for propelling boats, canoes and other water craft through shallow water.

It is a further object of the present invention to provide a jet propulsion system which minimizes the amount of sand, sediment and other debris carried by water into the inlet port.

It is another object of the present invention to provide a jet propulsion system which minimizes the amount sand and other sediment in the water used for cooling the motor.

A more general object of this invention is to provide a jet propulsion system which may be efficiently operated in water of varying depth and which may be easily and conveniently manufactured and maintained.

In summary, the jet propulsion system of this invention includes a jet housing having a conduit formed therein for the passage of water through the housing. The housing has an inlet port which includes an upper edge and a lower edge extending at least to the vertical plane defined by said upper edge so that the inlet port faces away from the bottom of said body of water. The housing also includes an outlet port spaced from said inlet port for expelling water from said conduit. An impeller is positioned in said housing between said inlet and outlet ports. The impeller is rotatable by a drive mechanism for drawing water inwardly through said inlet port, directing water past said impeller in an axial/rotational flow, and driving water through the outlet port to propel said water craft through said water. A stator structure is positioned in said conduit between said impeller and said outlet port for converting the rotational direction of the flow to axial flow outwardly through the outlet port. The stator structure defines a radially inner wall of said conduit, while the housing defines a radially outer wall of said conduit. A coolant delivery system for delivering a supply of water for cooling the drive mechanism. The coolant delivery system includes a coolant passageway for transporting water from said conduit to a pump reservoir associated with the drive mechanism. The coolant passageway includes an inlet aperture which opens into the conduit at a location between the impeller and the outlet. The inlet aperture is positioned closer to the radially inner wall of the conduit than the radially outer wall so that sand, sediment and other fine debris has been filtered from the cooling water by centrifugal force.

Additional objects and features of the invention will be more readily apparent from the following detailed description and appended claims when taken in conjunction with the drawings.

DETAILED DESCRIPTION OF THE INVENTION

Figure 1:
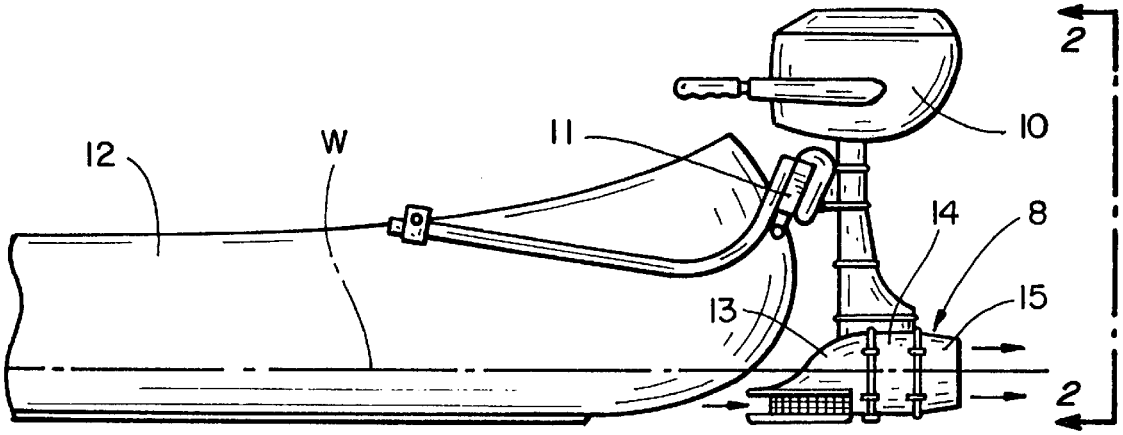
FIG. 1 is a side view of a jet drive in accordance with this invention, shown attached to an outboard motor mounted on a canoe.

Reference is now made in detail to the preferred embodiment of the invention, which is illustrated in the accompanying figures. Turning to the drawings, wherein like components are designated by like reference numerals throughout the various figures, attention is directed to FIGS. 1 and 2.

Figure 2:
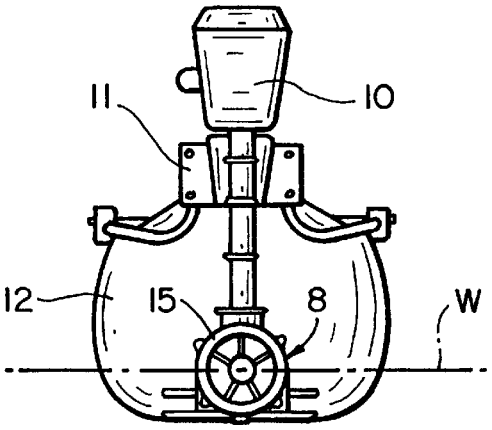
FIG.2 is an end view taken substantially along line 2—2 of FIG. 1.

FIGS. 1 and 2 show a jet drive or propulsion system 8 in accordance with this invention coupled to an outboard motor 10. As is known in the art, the outboard motor 10 is mounted to a suitable motor support 11 carried by a canoe 12. Any suitable outboard motor 10 and motor support 11 may be employed with the jet drive of this invention. Additionally, the jet drive 8 may be used with a variety of different types of boats and other water craft. As is shown particularly in FIG. 1, the jet drive 8 is preferably positioned so that the lowermost portion of the drive is coplanar with or spaced vertically above the lowermost point of the canoe 12. This arrangement is of particular advantage in that the jet drive is operable in water having sufficient depth for the craft to float, allowing the jet drive to power the boat through shallow areas and facilitating landing of the boat. However, it is to be understood that the jet drive 8 may also be mounted so that the propulsion system extends below the bottom of the boat.

Turning to FIGS. 3–8, the jet drive 8 will be described in more detail. The jet propulsion system 8 generally includes an inlet section 13, an impeller section 14, and a stator section 15. The inlet port 20 is sandwiched between upper and lower baffles 22 and 23. The inlet port 20 does not face downwardly toward the bottom of the river or lake but is instead oriented so that the water flows into the inlet port 20 from the periphery of the propulsion system. This significantly reduces the amount of sand, sediment and other debris pulled into the system with the water. In the illustrated modification, the peripheral edges of the upper and lower baffles 22 and 23 are substantially vertically aligned such that the inlet port faces in a horizontal direction. In other modifications, the edge of the lower baffle may extend outwardly beyond the edge of the upper baffle so that the inlet opening is inclined in an upward facing direction. However, the horizontal facing inlet port of the illustrated embodiment is preferred as it minimizes the depth required for operation of the jet drive. In the illustrated embodiment of this invention, the inlet port has a relatively short height, on the order of about 1.5 inches. The U-shaped configuration of the inlet port provides the inlet port with an opening which allows sufficient water to be drawn into the jet drive 8.

A screen 21 is spaced inwardly of the edges of the baffles 22 and 23, defining an inner opening. The surface area of the inlet port 20 between the peripheral edges of the baffles is greater than the surface area of the inner opening defined by the screen as is shown particularly in FIG. 4. During operation of the jet drive 8, the water flowing between the peripheral edges of the baffles flows at a relatively low velocity, with the velocity increasing as the water flow reaches the smaller area of the inlet screen 21. Reducing the velocity of the flow at the peripheral edge of the baffles 22 and 23 relative to the velocity of the flow through the screen 21 is of particular advantage. In the illustrated application, the upper baffle 22 is positioned close to the surface of the water W, for example within ½ inch of the water surface. The lower relative velocity at the peripheral edge of the upper baffle 22 prevents pockets of air from being trapped in the flow entering the jet drive 8. Similarly, the reduced velocity along the edge of the lower baffle 23 minimizes the entrainment of sand, gravel and other sediment in the flow of water entering the inlet port 20.

Figure 3:
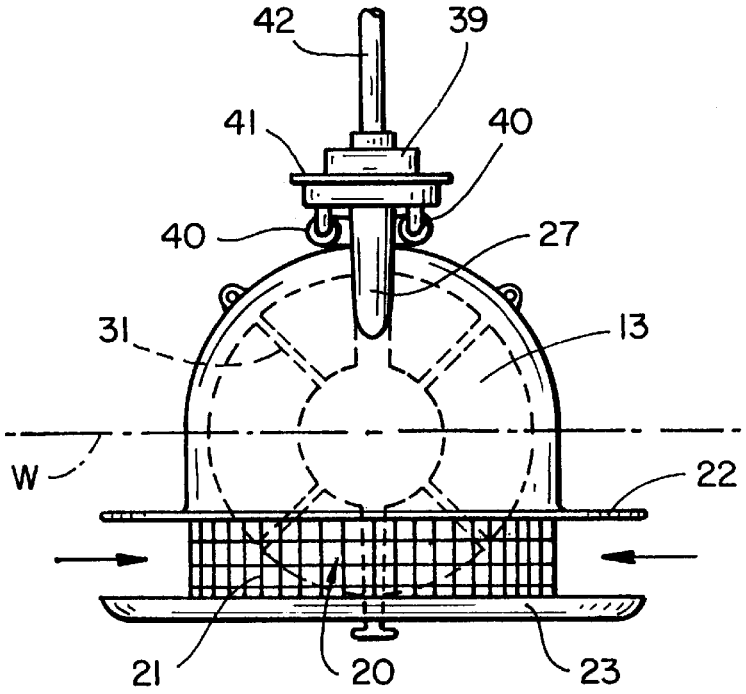
FIG. 3 is an enlarged, front end view of the jet drive of FIG. 1.

As is shown in FIG. 3, the outer edges of the lower baffle 23 are preferably curved to reduce the amount of sand, gravel and sediment collected when the jet drive 6 drags on the bottom of river or lake. With the baffles 22 and 23, the jet drive may be operated in shallow water. Depending upon the type of craft with which the jet drive is used, this depth may be as little as three inches.

Figure 5:
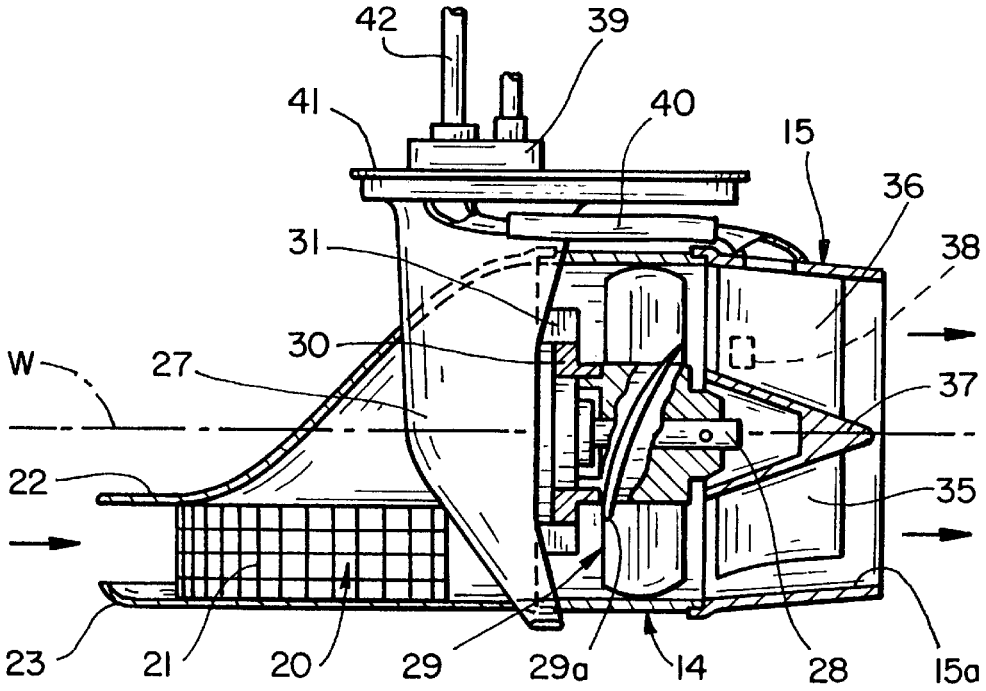
FIG. 5 is a cross sectional view taken substantially along line 5—5 of FIG. 4.

The gear drive housing 27 of the outboard motor extends through the inlet section 13 of the jet drive as is shown in FIGS. 3 and 5. A shaft 28 coupled to the drive mechanism (not shown) contained within the housing 27 extends outwardly from the rear surface of the housing. An impeller 29 is mounted to the shaft 28 and secured in place by a hub ring 30 which is mounted to the housing 27 by suitable fastening means such as a plurality of threaded fasteners. As is known in the art, gaskets or other suitable means (not shown) prevent water from seeping into the interior of the gear drive housing 27. The impeller 29 may be manufactured of stainless steel or other suitable materials and preferably includes 4 helically extending blades 29*a*. A plurality of struts 31 mount the impeller housing to the hub ring 30. The shaft 28 rotates the impeller 29, producing the suction for drawing water inwardly through the inlet section 13, driving the water through the impeller section 14 in an axial/rotational flow, and forcing the water through the stator section 15 at increased pressure to propel the boat or other small craft through the water.

Figure 6:
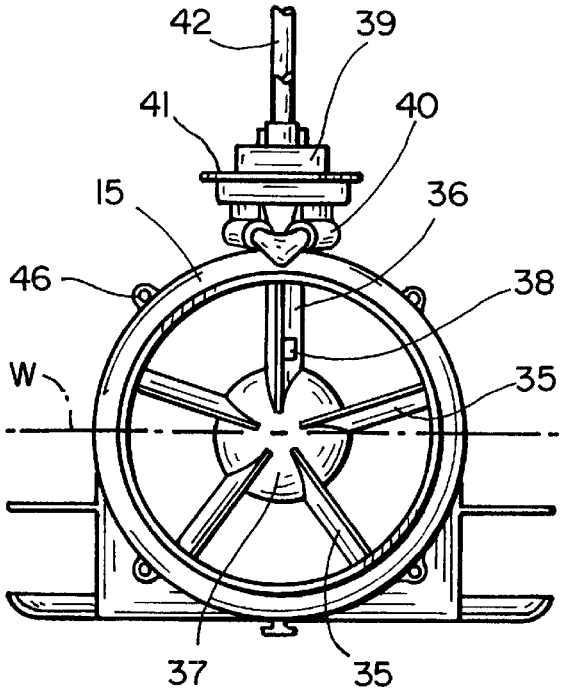
FIG. 6 is an enlarged end view of the jet drive of FIG. 3.
Figure 7:
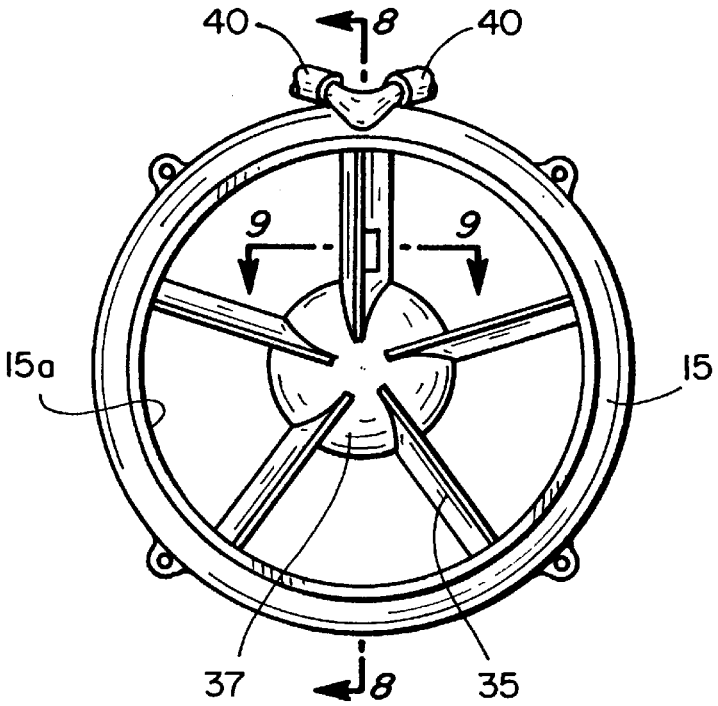
FIG. 7 is an enlarged view of the stator of the jet drive of FIG. 3.
Figure 8:
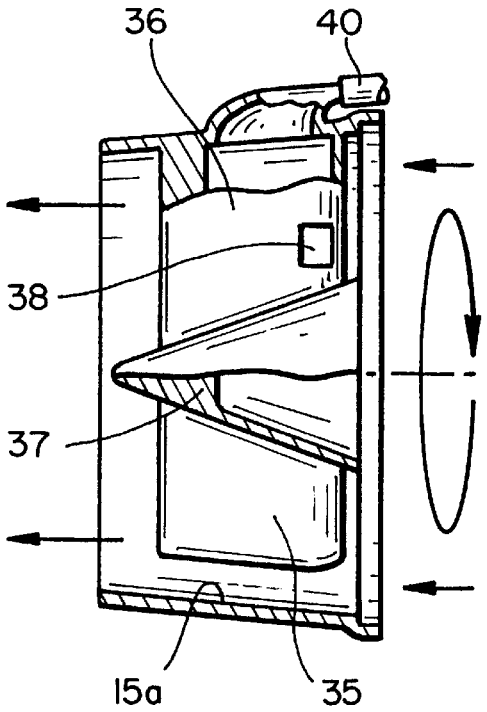
FIG. 8 is a cross sectional view taken substantially along line 8—8 of FIG. 7.

As is shown particularly in FIGS. 5 and 6, the stator section 15 includes a plurality of fixed directional vanes 35 and 36 mounted to a stator cone 37. Water leaving the impeller flows between the exterior surface of the stator cone 37, which defines a radially inner wall of the conduit in the stator section 15, and the interior of the wall 15*a* of the stator section housing, which defines the radially outer wall of the conduit. The vanes 35 and 36 extending between the radially inner and outer walls 37 and 15*a*, redirect the rotation component of the flow of the water leaving the impeller to a substantially axial flow of high pressure for propelling the boat through the water. The number, position and shape of the vanes are subject to considerable variation. In the illustrated embodiment of the invention, the stator 15 includes four solid vanes 35 and one hollow vane 36 which is used to supply the water for cooling the motor. The hollow vane 36 includes a port 38 formed in the leading surface of the vane 36 relative to the direction of rotation of the impeller 29 (indicated by the arrow in FIG. 8) for the flow of water from the interior of the stator 15 into the hollow vane 36. The interior passageway of the hollow vane 36 is connected to a pump 39 by hoses 40. The pump 39, which is mounted to an upper mounting flange 41 on the housing 27, is coupled to and driven by the drive shaft 42 of the outboard motor 10.

Figure 9:
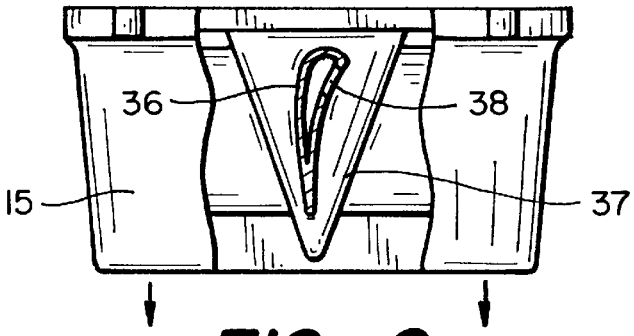
FIG. 9 is a side view, partially broken away, of the stator section of FIG. 7.

The jet drive 8 of this invention does not use screens, filter bowls or other mechanical means to remove sand and fine sediment from the cooling water, or a separate inlet passageway for collecting water for cooling the motor. Instead, some of the water driven through the jet drive by the impeller is used as the coolant. Any sand and sediment carried by the water traveling through the jet drive is substantially removed from the cooling water by centrifugal force when the water travels through the impeller section 14. As the water is driven through the impeller section, the centrifugal force created by the rotational flow moves debris radially outward toward the wall of the impeller section 14. As is shown particularly in FIGS. 7–9, the port 38 is preferably positioned near the outlet of the impeller section 14 and at the base of the vane 36, toward the center axis of the impeller 29 and stator cone 37, so that the water entering the vane 36 is substantially free of sand and sediment. Since the pressure of the axial flow near the center axis of the impeller is relatively low, the rotational flow of water impacts the vertical wall of the vane 36 at port 38 where the kinetic energy of the water creates a pressure head which drives the cooling water upwardly through the vane 36 to the cooling pump 39.

In the illustrated embodiment, the coolant passageway is formed a vane. However, it is to be understood that the stator structure is not to be limited to the configuration of this embodiment and other means may be used to form the coolant passageway and the inlet aperture.

Figure 4:
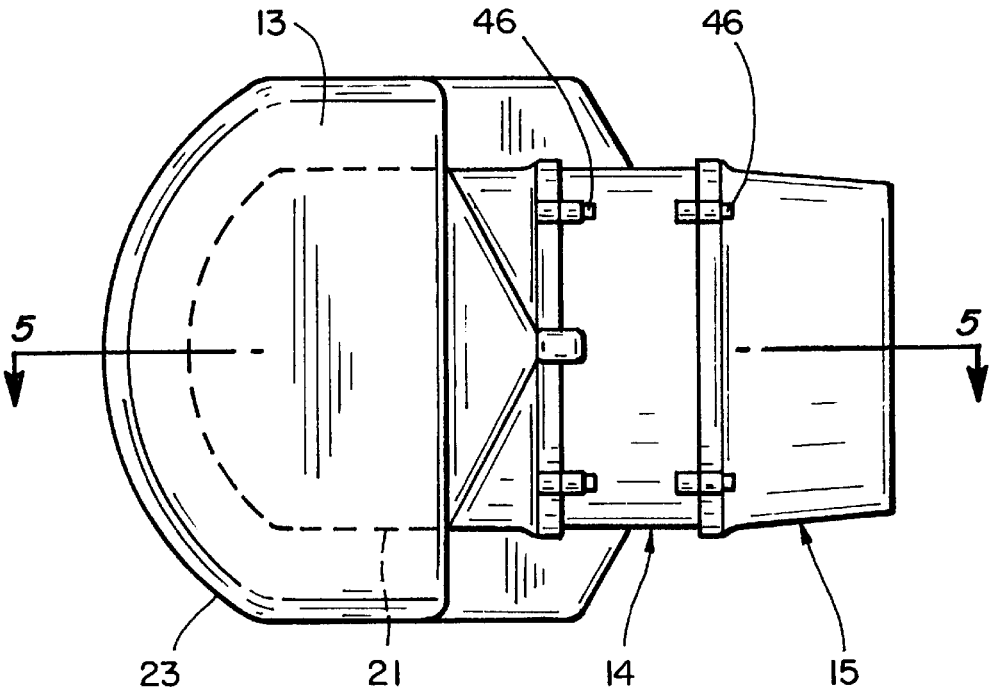
FIG. 4 is an enlarged, bottom plan view of the jet drive of FIG. 3.

The inlet, impeller and stator sections are secured together using suitable attachment means. In the illustrated embodiment, the inlet section 13, impeller section 14 and stator section 15 are separate components which are coupled together by a plurality of threaded fasteners 46. (FIG. 4).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A jet propulsion system for propelling a water craft through a body of water comprising:

a housing having a conduit formed therein for the passage of water, upper and lower baffles, an inlet port between said upper and lower baffles for delivering water to said conduit, and an outlet port for expelling water from said conduit, said upper and lower baffles each having a peripheral edge, said inlet port being spaced inwardly of said peripheral edges of said upper and lower baffles such that said inlet port has a flow area less than the flow area of the opening between the peripheral edges of said upper and lower baffles such that water flowing between the peripheral edges of said upper and lower baffles has a lower velocity than water flowing through said inlet port;

an impeller positioned in said housing between said inlet port and said outlet port, said impeller being rotatable by a drive assembly for drawing water inwardly through said inlet port, driving the water past said impeller in an axial/rotational flow, and moving the water through the outlet port; and a coolant delivery system for delivering a supply of water for cooling the drive assembly, said coolant delivery system including a coolant passageway for transporting water from said conduit to a pump reservoir coupled to the drive assembly, said coolant passageway including an inlet aperture positioned between said impeller and said outlet.

2. The propulsion system of claim 1 in which said peripheral edge of said lower baffle is vertically aligned with said peripheral edge of said upper baffle.

3. The propulsion system of claim 1 in which said housing includes an inlet screen for obstructing the passage of debris into said conduit, said inlet screen being spaced inwardly relative to said peripheral edges of said upper and lower baffles.

4. The propulsion system of claim 1 in which said inlet port has a substantially U-shaped configuration.

5. The propulsion system of claim 1 in which said inlet aperture is positioned near the center of rotation of the flow of water leaving said impeller such that debris has been centrifugally removed from the water entering said inlet port and the rotational energy of the water at said inlet aperture moves water through said coolant passageway to the pump reservoir.

6. A jet propulsion system for propelling a water craft through a body of water comprising:

a housing having a conduit formed therein for the passage of water, an inlet port for delivering water to said conduit and an outlet port for expelling water from said conduit, said inlet port being configured such that said inlet port faces away from the bottom of the body of water;

an impeller positioned in said housing between said inlet port and said outlet port, said impeller being rotatable by a drive assembly for drawing water inwardly through said inlet port, driving the water past said impeller in an axial/rotational flow, and moving the water through the outlet port;

a coolant delivery system for delivering a supply of water for cooling the drive assembly, said coolant delivery system including a coolant passageway for transporting water from said conduit to a pump reservoir coupled to the drive assembly, said coolant passageway including an inlet aperture positioned between said impeller and said outlet;and a stator structure positioned in said conduit between said impeller and said outlet port, said stator structure defining a radially inner wall of said conduit and said housing defining a radially outer wall of said conduit, said inlet aperture being positioned closer to said radially inner wall than said radially outer wall.

7. The propulsion system of claim 6 in which said stator structure includes at least one vane extending between said radially inner wall and said radially outer wall, and in which said inlet aperture is formed in said vane and said coolant passageway extends through said vane.

8. The propulsion system of claim 7 in which said vane has a leading surface opposing the direction of rotation of said impeller, said inlet aperture being formed in said leading surface.

9. The propulsion system of claim 6 in which said inlet aperture is positioned adjacent said radially inner wall of said conduit.

10. A jet propulsion system for propelling a water craft through a body of water comprising:

a jet housing having a conduit formed therethrough for the passage of water, said housing having upper and lower baffles and an inlet port between said baffles and spaced inwardly of the peripheral edges of said upper and lower baffles such that said inlet port has a flow area less than the flow area of the opening between the peripheral edges of said upper and lower baffles such that water flowing between the peripheral edges of said upper and lower baffles has a lower velocity than water flowing through said inlet port, said housing having an outlet port spaced from said inlet port for expelling water from said conduit; and an impeller mounted in said conduit between said inlet port and said outlet port, said impeller drawing water inwardly through said inlet port and forcing the water through the outlet port to propel said water craft through said body of water.

11. The propulsion system of claim 10 in which said housing includes an inlet screen spaced inwardly of the peripheral edges of said upper and lower baffles.

12. The propulsion system of claim 10 in which the peripheral edges of said upper and lower baffles are substantially vertically aligned so that said water enters said inlet port in a substantially horizontal flow.

13. The propulsion system of claim 10 in which said inlet port has a substantially U-shaped configuration.

14. A jet propulsion system for propelling a water craft through a body of water comprising:

a housing having a conduit formed therein for the passage of water, an inlet port for delivering water to said conduit and an outlet port for expelling water from said conduit;

a rotary impeller positioned in said housing between said inlet port and said outlet port for drawing water inwardly through said inlet port, directing water past said impeller in an axial/rotational flow, and driving water through the outlet port to propel said water craft through said water, said impeller being rotatable by a drive mechanism;

a stator structure positioned in said conduit between said impeller and said outlet port, said stator structure defining a radially inner wall of said conduit and said housing defining a radially outer wall of said conduit; and a coolant delivery system for delivering a supply of water for cooling the drive mechanism, said coolant delivery system including a coolant passageway for transporting water from said conduit to a pump reservoir, said coolant passageway including an inlet aperture positioned between said impeller and said outlet, said inlet aperture being positioned closer to said radially inner wall than said radially outer wall of said conduit.

15. The propulsion system of claim 14 in which said stator structure includes at least one vane extending between said radially inner wall and said radially outer wall, and in which said inlet aperture is formed in said vane and said coolant passageway extends through said vane.

16. The propulsion system of claim 15 in which said vane has a leading surface opposing the direction of rotation of said impeller, said inlet aperture being formed in said leading surface of said vane.

17. The propulsion system of claim 14 in which said inlet aperture is positioned near the center of rotation of the flow of water leaving said impeller such that debris has been centrifugally removed from the water entering said inlet port and the rotational energy of the water at said inlet aperture moves water through said coolant passageway to said pump reservoir.

18. The propulsion system of claim 14 in which said inlet aperture is positioned adjacent said radially inner wall of said conduit.

19. The propulsion system of claim 14, and further comprising a drive assembly coupled to said impeller.

20. The propulsion system of claim 19 in which said drive assembly includes an outboard motor.

21. A jet propulsion system for propelling a water craft through a body of water comprising:

a housing having a conduit formed therein for the passage of water, an inlet port for delivering water to said conduit and an outlet port for expelling water from said conduit, said inlet port being configured such that said inlet port faces away from the bottom of the body of water, said inlet port having a substantially U-shaped configuration;

an impeller positioned in said housing between said inlet port and said outlet port, said impeller being rotatable by a drive assembly for drawing water inwardly through said inlet port, driving the water past said impeller in an axial/rotational flow, and moving the water through the outlet port; and a coolant delivery system for delivering a supply of water for cooling the drive assembly, said coolant delivery system including a coolant passageway for transporting water from said conduit to a pump reservoir coupled to the drive assembly, said coolant passageway including an inlet aperture positioned between said impeller and said outlet.

22. A jet propulsion system for propelling a water craft through a body of water comprising:

a housing having a conduit formed therein for the passage of water, an inlet port for delivering water to said conduit and an outlet port for expelling water from said conduit, said inlet port being configured such that said inlet port faces away from the bottom of the body of water;

an impeller positioned in said housing between said inlet port and said outlet port, said impeller being rotatable by a drive assembly for drawing water inwardly through said inlet port, driving the water past said impeller in an axial/rotational flow, and moving the water through the outlet port; and a coolant delivery system for delivering a supply of water for cooling the drive assembly, said coolant delivery system including a coolant passageway for transporting water from said conduit to a pump reservoir coupled to the drive assembly, said coolant passageway including an inlet aperture positioned between said impeller and said outlet, said inlet aperture being positioned near the center of rotation of the flow of water leaving said impeller such that debris has been centrifugally removed from the water entering said inlet port and the rotational energy of the water at said inlet aperture moves water through said coolant passageway to the pump reservoir.

* * * * *